US007837525B2

(12) United States Patent
Napolitano et al.

(10) Patent No.: US 7,837,525 B2
(45) Date of Patent: Nov. 23, 2010

(54) AUTONOMOUS DATA RELAY BUOY

(75) Inventors: Domenic F. Napolitano, Barrington, RI (US); Craig W. Bradford, Boston, MA (US); William E. Komm, Portsmouth, RI (US); Marc A. Brown, Tubac, AZ (US); Frank H. Hitzke, Sarona, WI (US); David A. Sharp, Newport, RI (US); Michael W. Little, Cranston, RI (US); Douglas L. Veilleux, II, Rochester, MA (US)

(73) Assignee: Raytheon Company, Waltham, MA (US)

( * ) Notice: Subject to any disclaimer, the term of this patent is extended or adjusted under 35 U.S.C. 154(b) by 75 days.

(21) Appl. No.: 12/393,139

(22) Filed: Feb. 26, 2009

(65) Prior Publication Data

US 2009/0279383 A1 Nov. 12, 2009

Related U.S. Application Data

(60) Provisional application No. 61/031,551, filed on Feb. 26, 2008.

(51) Int. Cl.
*B63B 22/20* (2006.01)

(52) U.S. Cl. ..... 441/29; 441/23

(58) Field of Classification Search ..... 441/1, 441/21, 23, 28, 29; 367/4
See application file for complete search history.

(56) References Cited

U.S. PATENT DOCUMENTS 2,497,852 A * 2/1950 Arenstein ..... 441/11
2,998,790 A 9/1961 Mason
3,132,322 A * 5/1964 Maes ..... 367/4
3,595,195 A 7/1971 Van Eek et al.
4,464,131 A * 8/1984 Plante et al. ..... 441/29
5,449,307 A 9/1995 Fuereder
5,902,163 A * 5/1999 Baruzzi et al. ..... 441/23

FOREIGN PATENT DOCUMENTS

DE 42 41 445 A1 6/1994
DE 42 41 445 C1 6/1994
GB 1 441 064 6/1976

OTHER PUBLICATIONS

R. Detrick, D. Frye, J. Collins, J. Gobat, M. Grosenbaugh, R. Petit, A. Plueddeman, K. Von Der Heudt, B. Wooding (WHOI); J. Orcutt, J. Berger, R. Harriss, F. Vernon (SIO), J. Halkyard, E. Horton (DOT), DEOS Moored Buoy Observatory Design Study, Aug. 2000, pp. 1-97.

(Continued)

*Primary Examiner*—Lars A Olson
(74) *Attorney, Agent, or Firm*—Daly, Crowley, Mofford & Durkee, LLP

(57) ABSTRACT

An easily deployable data relay buoy, in some embodiments, has a diesel powered alternator and storage battery, providing long service life. The data relay buoy has mechanical characteristics that allow it to maintain antenna stability in the presence of seas states from at least zero through four and to survive in sea states up to sea state six.

16 Claims, 5 Drawing Sheets

OTHER PUBLICATIONS

Hiroyuki Sekino, Andrew M. Clark, A Near Real-Time Buoy Telemetry System for Observation of Marine Earthquake/Crustal Deformation in Japan, 2003, IEEE, pp. 266-271.

PCT Search Report of the ISA dated Sep. 23, 2010 for PCT/US2009/035233.

PCT Written Opinion of the ISA dated Sep. 23, 2010 for PCT/US2009/035233.

PCT International Preliminary Report on Patentability of the ISA dated Sep. 28, 2010 for PCT/US2009/035233.

* cited by examiner

AUTONOMOUS DATA RELAY BUOY

CROSS REFERENCE TO RELATED APPLICATIONS

This application claims the benefit under 35 U.S.C. §119 (e) of U.S. Provisional Application No. 61/031,551 filed Feb. 26, 2008, which application is incorporated herein by reference in its entirety.

STATEMENT REGARDING FEDERALLY SPONSORED RESEARCH

This invention was made with government support under Contract No. N00039-04-C-0035 awarded by U.S. Navy. The government has certain rights in the invention.

FIELD OF THE INVENTION

This invention relates generally to deployable ocean systems and, more particularly, to a deployable buoy, which has self-generated power.

BACKGROUND OF THE INVENTION

As is known, there exist numerous types of floating apparatus for use in water, for example, in the ocean. Some portions of the floating apparatus may be underwater and some portions may be on or near the surface of the water. The portion at or near to the surface of the water is often referred to as a buoy.

Buoys are used in a variety of applications. For example, both relatively large and relatively small buoys are used as ocean markers, to mark water channels or to mark obstructions in the water. Some conventional buoys used as markers are totally passive and may have one or more colors to represent information. Other conventional buoys used as markers have lights, visible to a person on a ship, or audible devices, such as bells or horns, which may be heard by a person on a ship. A conventional buoy used as a marker is generally not free-floating, meaning that the buoy is tethered to an anchor or other fixed object disposed on the ocean bottom.

More complex systems having buoys are used in conjunction with electronics as measurement platforms, which may, for example, provide measurements of temperatures of the ocean, or measurements of currents in the ocean. Conventional buoys used as measurement platforms may be either free-floating (i.e., without an anchor), or non free-floating (i.e., with an anchor).

Still more complex systems having buoys are used in conjunction with electronics as detection platforms, which may, for example, be coupled to acoustic sensors in order to detect vessels, for example, submarines, in the ocean. One such detection platform is conventionally referred to as a sonobuoy, of which there are many types. Most sonobuoys employ free-floating buoys, are battery powered, and have an operation lifetime of a few hours.

Still more complex conventional systems having buoys and used as detection platforms exist. One such system, made by Harris Corporation, Melbourne, Fla., provided a very large diesel powered buoy, anchored to the ocean bottom. This buoy transmitted radio signals to a receiving station. This buoy was large enough for a person to enter. This existing buoy suffered from large size and resulting difficult deployment and overall low power generating efficiency.

It would be desirable to have a buoy, which is self powered, which is able to generate a large amount of power, which has high overall power generating efficiency and resulting long operational life in the ocean, which is small and easily deployed, and which is mechanically angularly stable at higher seas states despite its small size, resulting is good signal integrity of radio frequency signals received from the buoy.

SUMMARY OF THE INVENTION

In accordance with one aspect of the present invention, a buoy for deployment in the ocean includes an engine and an electric starter motor coupled to the engine. The buoy further includes an electrical alternator coupled to the engine, thee electrical alternator is configured to generate electricity when the engine is running. The buoy further includes a battery coupled to the electrical alternator, the battery having a battery voltage. The electrical alternator is configured to charge the battery with the electricity when the engine is running. The buoy further includes a fuel tank configured as a soft, flexible, and collapsible bladder coupled to the engine, configured to prevent fuel sloshing. The fuel tank is continually surrounded by seawater such that, as the fuel is expended and the fuel tank collapses accordingly, seawater continually fills in around the fuel tank resulting in a displacement of the buoy remaining substantially unchanged.

The present invention provides a buoy of the present invention that is self powered, is able to generate a large amount of power, has high overall power generating efficiency and resulting long operational life in the ocean, is small and easily deployed, and is mechanically angularly stable at higher seas states despite its small size, resulting is good signal integrity of radio frequency signals received from the buoy.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, some introductory concepts and terminology are explained. As used herein, the term "sea sate" is a numerical value used to describe a condition of the ocean, including a wave height value, and a wave period. It will be understood that the sea state is often also related to a wind speed value.

A known Pierson—Moskowitz sea state table is provided below as Table I.

TABLE I

| Wind Speed (Kts) | Sea State | Significant Wave (Ft) | Significant Range of Periods (Sec) | Average Period (Sec) | Average Length of Waves (FT) |
|---|---|---|---|---|---|
| 3 | 0 | <.5 | <.5-1 | 0.5 | 1.5 |
| 4 | 0 | <.5 | .5-1 | 1 | 2 |
| 5 | 1 | 0.5 | 1-2.5 | 1.5 | 9.5 |
| 7 | 1 | 1 | 1-3.5 | 2 | 13 |
| 8 | 1 | 1 | 1-4 | 2 | 16 |
| 9 | 2 | 1.5 | 1.5-4 | 2.5 | 20 |
| 10 | 2 | 2 | 1.5-5 | 3 | 26 |
| 11 | 2.5 | 2.5 | 1.5-5.5 | 3 | 33 |
| 13 | 2.5 | 3 | 2-6 | 3.5 | 39.5 |
| 14 | 3 | 3.5 | 2-6.5 | 3.5 | 46 |
| 15 | 3 | 4 | 2-7 | 4 | 52.5 |
| 16 | 3.5 | 4.5 | 2.5-7 | 4 | 59 |
| 17 | 3.5 | 5 | 2.5-7.5 | 4.5 | 65.5 |
| 18 | 4 | 6 | 2.5-8.5 | 5 | 79 |
| 19 | 4 | 7 | 3-9 | 5 | 92 |
| 20 | 4 | 7.5 | 3-9.5 | 5.5 | 99 |
| 21 | 5 | 8 | 3-10 | 5.5 | 105 |
| 22 | 5 | 9 | 3.5-10.5 | 6 | 118 |
| 23 | 5 | 10 | 3.5-11 | 6 | 131.5 |
| 25 | 5 | 12 | 4-12 | 7 | 157.5 |
| 27 | 6 | 14 | 4-13 | 7.5 | 184 |
| 29 | 6 | 16 | 4.5-13.5 | 8 | 210 |
| 31 | 6 | 18 | 4.5-14.5 | 8.5 | 236.5 |
| 33 | 6 | 20 | 5-15.5 | 9 | 262.5 |
| 37 | 7 | 25 | 5.5-17 | 10 | 328.5 |
| 40 | 7 | 30 | 6-19 | 11 | 394 |
| 43 | 7 | 35 | 6.5-21 | 12 | 460 |
| 46 | 7 | 40 | 7-22 | 12.5 | 525.5 |
| 49 | 8 | 45 | 7.5-23 | 13 | 591 |
| 52 | 8 | 50 | 7.5-24 | 14 | 566 |
| 54 | 8 | 55 | 8-25.5 | 14.5 | 722.5 |
| 57 | 8 | 60 | 8.5-26.5 | 15 | 788 |
| 61 | 9 | 70 | 9-28.5 | 16.5 | 920 |
| 65 | 9 | 80 | 10-30.5 | 17.5 | 1099 |
| 69 | 9 | 90 | 10.5-32.5 | 18.5 | 1182 |

It will also be understood that the sea state is often also related to an ocean current speed value. The ocean speed current value will be understood to include two components, referred to herein as an "average horizontal component" and a "wave-induced component," also referred to herein as an "oscillating component." The average horizontal component is a component that has an average speed relative to the earth. The wave-induced component is a rotational component that rotates once each wave period, and which is affected in magnitude by both the wave height and the wave period. As used herein, the term "wave-induced horizontal component," or "oscillating horizontal component," refers to a projection of the rotating wave motion of the "wave-induced component" onto a horizontal plane.

Figures 1, 1A:
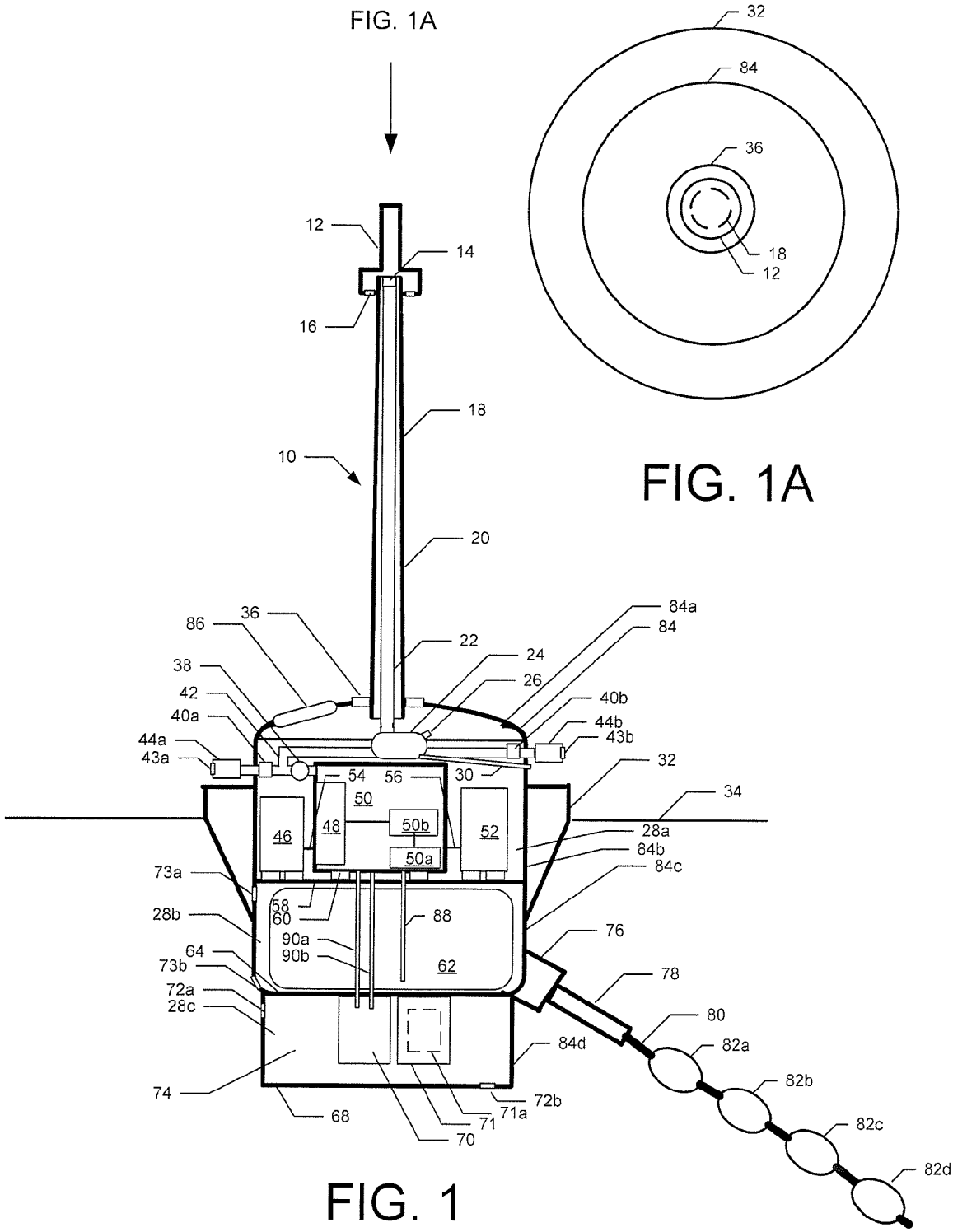
FIG. 1 is a side view of an autonomous data relay buoy.
FIG. 1A is a top view of the autonomous data relay buoy of FIG. 1.

Referring to FIG. 1, an exemplary autonomous data relay buoy 10 is shown statically floating in water 34, without regard to waves or currents, and also without regard to any particular forces upon the exemplary autonomous data relay buoy 10 that may otherwise tend to cause the exemplary autonomous data relay buoy 10 to tilt. Forces and tilt considerations are discussed below in conjunction with FIG. 1B.

The autonomous data relay buoy 10 includes a hull 84, which can be comprised of joined hull portions 84*a*, 84*b*, 84*c*, 84*d*. The first and second hull portion 84*a*, 84*b*, respectively, can be joined together in a fashion so as to form a dry compartment 28*a*. To this end, there may be a seal, for example, an o-ring seal at a joint between the first and second hull portions 84*a*, 84*b*.

The third hull portion 84*c* can form a compartment 28*b*. In some arrangements, the compartment 28*b* is sealed from the compartment 28*a*, for example, with a solid boundary or floor 56. In other arrangements, the compartment 28*b* is open to the compartment 28*a*. In some arrangements, the compartment 28*b* is a dry compartment and in other arrangements, the compartment 28*b* fills partially with water once the autonomous data relay buoy 10 is deployed in the water 34. To this end, the compartment 28*b* can include ports, of which ports 73*a*, 73*b* are but two examples.

The fourth hull portion 84*d* forms a compartment 28*c*. The fourth hull portion 84*d* includes ports, of which a ports 72*a*, 72*b* are but two examples, which allows compartment 28*c* to fill with water once the autonomous data relay buoy 10 is deployed in the water 34. In some arrangements, the third hull portion 84*c* is sealed from the fourth hull portion 84*d*, for example, with a solid boundary 64.

In some arrangements, the hull 84 can include a sealed hatch 86, which can be opened for access.

The autonomous data relay buoy 10 can include a diesel engine 50. A diesel engine starter motor 50*a* is coupled to the diesel engine 50. A starter battery 50*b* is coupled to the diesel engine starter motor 50*a*. The starter battery 50*b* and the diesel engine starter motor 50*a* are configured to start the diesel engine.

The autonomous data relay buoy 10 further includes an electrical generator 48 coupled to the diesel engine 50, which is configured to generate electricity when the diesel engine 50 is running in order to generate electricity to provide a charging current to charge a storage battery 46 and also to charge the starter battery 50*b*. In some arrangements, the alternator 46 is capable of providing a charging current of at least four hundred amperes at a voltage of about fifty volts, for a power of at least twenty thousand watts. In some arrangements, the storage battery 46 has a capacity of at least six thousand watt-hours. In some arrangements, the storage battery 46 has a nominal voltage of about forty-eight volts.

The autonomous data relay buoy 10 further includes an electronic circuit 52 coupled to the storage battery 46 and configured to compare the battery voltage of the storage battery 46 with a battery voltage threshold. The electronic circuit 52 is also coupled to the electric starter motor 50*a* and to the diesel engine 50.

In operation, the electronic circuit 52 is configured to start the diesel engine 50 and to run the diesel engine 50 for a period of time when the battery voltage of the storage battery 46 is below the battery voltage threshold. The electronic circuit 52 is also configured to stop the diesel engine after the period of time. The period of time during which the diesel engine 50 is running is determined in accordance with at least one of the battery voltage of the storage battery 46, the charging current flowing into the storage battery 46, or a predetermined time value.

The autonomous data relay buoy 10 also includes a diesel fuel tank 62 coupled to the diesel engine 50 with a fuel tube 88. The diesel fuel tank 62 is configured to hold a volume of diesel fuel sufficient to run the diesel engine 50 sufficiently to maintain a full battery charge of the storage battery 46 (and of the starter battery 50*b*) for at least thirty days while supplying an average of at least three hundred fifty watts of power from the storage battery 46. In other arrangements, the diesel fuel tank 62 is configured to hold a volume of diesel fuel sufficient to run the diesel engine 50 sufficiently to maintain a full battery charge of the storage battery 46 (and of the starter battery 50*b*) for at least sixty days while supplying an average of at least three hundred fifty watts of power from the storage battery 46.

In some arrangements, the diesel fuel tank 62 is a soft, flexible, and collapsible fuel tank. It will be understood that, for arrangements in which the space surrounding the diesel fuel tank 62 is filled with water, for example, via the ports 73*a*, 73*b*, a displacement of the buoy 10 will remain substantially unchanged as diesel fuel within the diesel fuel tank 62 is expended. In other arrangements, the diesel fuel tank 62 is rigid. The diesel fuel tank 62 can be designed to prevent sloshing of diesel fuel.

In some arrangements, the diesel engine 50, the electrical alternator 48, the electronic circuit 52, and the storage battery 46 are selected to result in an overall efficiency corresponding to less than three hundred grains of diesel fuel per kilowatt-hour.

In some arrangements, the diesel engine 50 is liquid cooled, but in a sealed (non-seawater cooled) configuration. In these arrangements, the autonomous data relay buoy 10 can include a cooling heat exchanger 70, which can be coupled to the diesel engine 50 with cooling liquid tubes 90*a*, 90*b*. The cooling heat exchanger 70 can be within the chamber 28*c*, which is filled with seawater 74. It will be apparent that the seawater 74 can provide cooling of the cooling heat exchanger 70.

In some arrangements, the autonomous data relay buoy 10 can include further electronic circuits 71*a*, within a sealed enclosure 71, which is disposed within the seawater 74. The sealed enclosure 71 can provide cooling of the electronic circuits 71*a*.

In some arrangements, the diesel engine 50 is coupled to a floor 58 with vibration mounts, e.g., the vibration mount 60. This arrangement has particular advantages, which will be apparent from discussion below in conjunction with FIGS. 2 and 2A, when the autonomous data relay buoy 10 is used in clandestine applications, or in which the autonomous data relay buoy 10 is used in conjunction with acoustic sensors in the water 34.

The autonomous data relay buoy 10 can include a flotation collar 32 configured to keep the autonomous data relay buoy 10 at a desired depth in the water 34 and also to help maintain the autonomous data relay buoy 10 at a desired attitude in the water 34. A shape of the flotation collar 32 can be selected to provide a particular drag and/or to provide a particular position of a center of drag, discussed more fully below in conjunction with FIG. 1B.

As will be understood, the diesel engine 50 needs air for combustion. To this end, the autonomous data relay buoy 10 can include a mast 18 with an inner air tube 22. In some embodiments, the mast 18 is made of fiberglass. The air tube 22 can be coupled to a baffle 12 at a distal end of the air tube 22. The baffle 12 can include air passages, e.g., the air passage 16. The baffle 12 is configured to keep water out of the air tube 22, but to allow air to enter the air tube 22. An air valve 14 can also be disposed at the distal end of the air tube 22.

In operation, the air valve 14 can be opened by electrical actuation by the electronic circuit 52 when the diesel engine 50 is running, and the air valve 14 can be closed by electrical actuation by the electronic circuit 52 when the diesel engine 50 is not running. The electronic circuit 52 is described more fully below in conjunction with FIG. 3.

In other arrangements, the air valve 14 is mechanically actuated to open and close, for example, by a vacuum created in the air tube 22, so as to open when the diesel engine is running and attempting to draw combustion air, and so as to close when there is no vacuum. In other arrangements, there is no air valve 14.

At the other end, the proximal end, the air tube 22 can couple to an air-water separator 24 having an air escape passage 26 and a water drain 30. The air escape passage 26 allows air to enter the chamber 28*a* for use in combustion by the diesel engine 50. Any water that enters the air tube 22 leaves the chamber 28*a* by way of the water drain 30.

The diesel engine 50 can couple to an exhaust assembly 42 having a muffler 38, two gas valves 40*a*, 40*b*, and two baffles 44*a*, 44*b*. The two baffles 44*a*, 44*b* can be disposed on opposite sides of the buoy as shown so that one of the baffles will be out of the water no matter which way the buoy 10 tilts. The baffles 44*a*, 44*b* can include gas passages 44*a*, 44*b*, respectively. Each one of the baffles 44*a*, 44*b* is configured to keep some water out of the exhaust assembly 42, but to allow exhaust gas from the diesel engine 50 to escape the exhaust assembly 42.

In operation, as described above for the air valve, the gas valves 40*a*, 40*b* can be opened by electrical actuation by the electronic circuit 52 when the diesel engine 50 is running, and the gas valves 40*a*, 40*b* can be closed by electrical actuation by the electronic circuit 52 when the diesel engine 50 is not running. In other arrangements, there is but one exhaust baffle 44*a* and but one gas valve 40*a*. In other arrangements, there is no gas valve.

In other arrangements, the gas valves 40*a*, 40*b* are mechanically actuated to open and close, for example, by a pressure created in the exhaust assembly 42, so as to open when the diesel engine is running and attempting to exhaust combustion gasses, and so as to close when there is no pressure.

The mast 18 can also include a radio frequency antenna 20 insulated from the hull 84 by an insulator ring 36. The hull 84 and the water 34 form a ground plane for the antenna 20.

The antenna 20 can be coupled to the electronic circuit 52 and/or to the electronic circuit 71*a* as described more fully below in conjunction with FIG. 3.

The autonomous data relay buoy 10 can include a tether assembly 76 having a semi-rigid strain relief section 78 and a flexible section 80. The flexible section 80 can be, or can otherwise contain, a signal cable, for example, a fiber optic cable or an electrical cable, which can couple to the electronic circuit 52 and/or to the electronic circuit 71*a*.

Floats 82*a*-82*d* can be coupled to the flexible section 80. It will become apparent from discussion below in conjunction with FIG. 1B that the floats 82*a*-82*b* can cause the flexible section 80 to be aligned in a desired way in the water 34, and therefore, any force along an axis of the flexible section 80 will tend to tilt the autonomous data relay buoy 10 less.

In some alternate embodiments, the diesel engine 50 can be another type of engine, for example, a gasoline engine and the fuel in the tank 62 can be another type of fuel, for example, gasoline. In some alternate embodiments, the starter battery 50*b* and the storage battery 46 can be the same battery used to both start the engine 50 and power the rest of the buoy 10. In some alternate embodiments, the chamber 28*b* and the associated fuel tank 62 can be below the virtual mass chamber 28*c*.

Referring now to FIG. 1A, a top view of the autonomous data relay buoy 10 is indicative of a round hull 84, a round flotation collar 32, a round mast 18, a round baffle 12, and a round insulator ring 36.

Figure 1B:
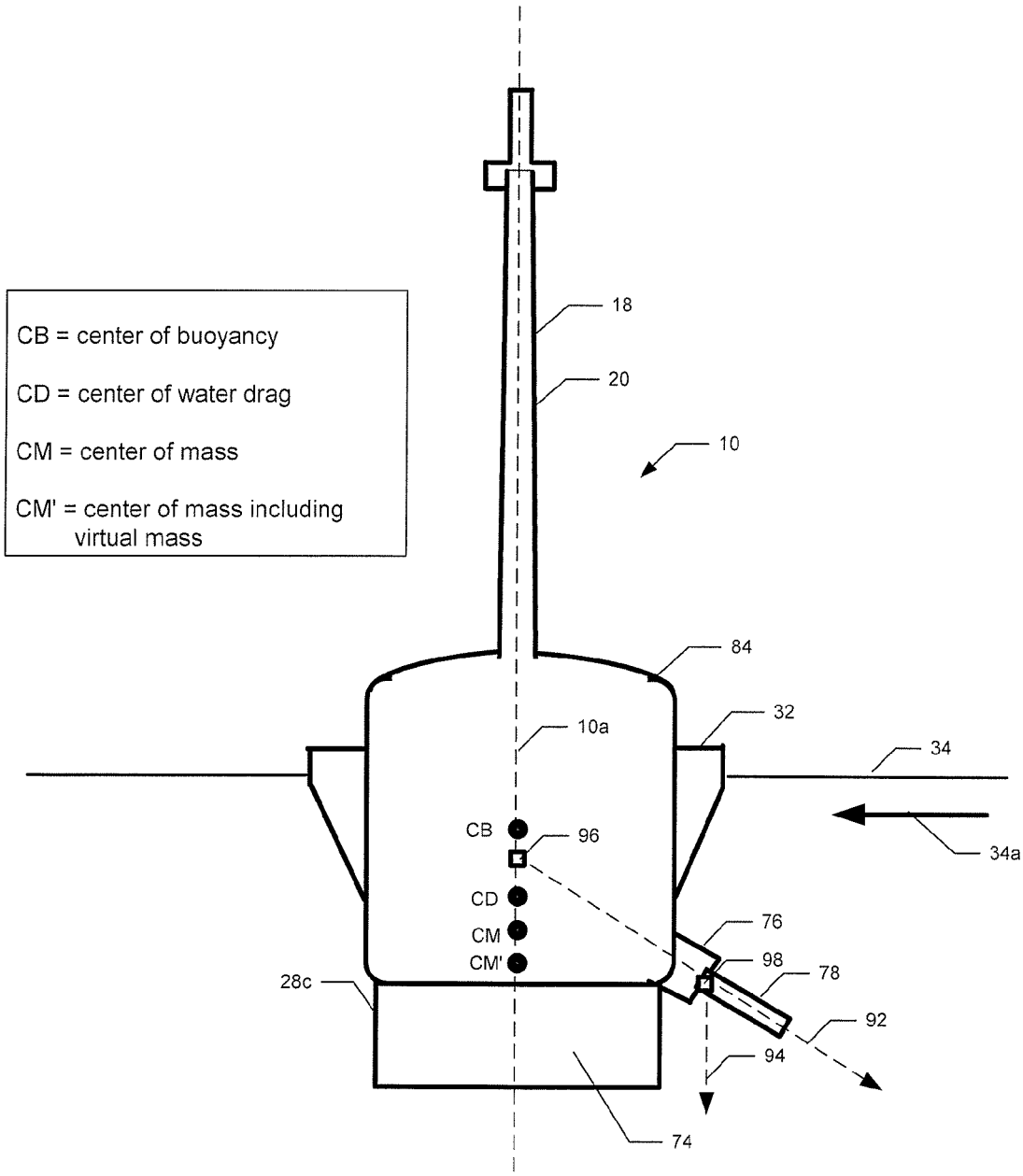
FIG. 1B is another side view of the autonomous data relay buoy of FIG. 1 showing a center of buoyancy, a center of mass, a center of drag, and a virtual center of mass.

Referring now to FIG. 1B, the autonomous data relay buoy 10 is shown in outline form. The autonomous data relay buoy 10 has a central vertical axis 10*a*. A center of buoyancy, CB, a dry center of mass, CM, and a center of water drag, CD, are disposed generally along the central vertical axis 10*a*, however, they need not be exactly on the axis 10*a*. The autonomous data relay buoy 10 also has a virtual center of mass, CM', also generally along the central vertical axis 10*a*, resulting from the seawater 74 being within the chamber 28*c* once the autonomous data relay buoy 10 is deployed in the water 34.

In general, it is desirable that the autonomous data relay buoy 10 maintains an orientation in the water 34 such that the central vertical axis 10*a* of the autonomous data relay buoy 10 maintains a bounded range of angles near to vertical relative to the earth. If the autonomous data relay buoy 10 were to tilt greatly, reception of radio signals generated by the autonomous data relay buoy 10 might be greatly degraded. The degradation can occur due to two effects.

A first effect is associated with a transmitting beampattern (not shown) of the antenna 20 within the mast 18. In some arrangements, the transmitting beampattern has a maximum power near to a direction perpendicular to the central vertical axis 10*a* and a null near to a direction upward along the central vertical axis. Dynamic movement of the antenna 20 tends to result in power fluctuations of the received radio signal at a receiving station due to movement of the transmitting beampattern relative to the receiving station.

A second effect is due to changes in impedance of the antenna 20 as the angle of the antenna 20 changes relative to its associated ground plane. As described above, the ground plane associated with the antenna 20 is comprised of effects from the hull 84 and from the water 34. Impedance fluctuations may not only cause power fluctuations in the signal transmitted by the antenna 20, but can also cause impedance mismatches with the electronics circuit 52 (FIG. 1) used to generate the transmitted signal. The impedance mismatches can cause a wide variety of effects, including, but not limited to, changes in fundamental frequency of the transmitted signal, generation of spurious frequencies (spurs) within the transmitted signal, unwanted oscillations of the transmitted signal, and overheating of the electronics circuit 52 and/or 71*a*.

Static stability of the autonomous data relay buoy 10 can be considered under two conditions. Under a first static condition, the ocean current 34*a* has both a zero average horizontal component and a zero oscillating component (no wave motion), i.e., there is no current 34*a*, and no waves. Under this condition, it will be well recognized that an object floating in water achieves an orientation such that the center of mass is below the center of buoyancy. If the reverse were true, if the center of buoyancy were below the center of mass, the object would flip over. In essence, there is an upward force acting upon the center of buoyancy, CB, and there is a downward force acting upon the center of mass, CM, which tends to keep the center of mass, CM, directly below the center of buoyancy, CB. Any static tilt of the autonomous data relay buoy 10 results in a torque of the two forces, which tends to statically un-tilt the autonomous data relay buoy 10. It is desirable that the center of mass, CM, and the center of buoyancy, CB, be widely spaced.

Under a second static condition, when the ocean current 34*a* has a non-zero average horizontal component but a zero oscillating component (no wave motion), a static horizontal force acts upon the center of drag, CD, in addition to the two above-described forces. The force acting upon the center of drag, CD, tends to tilt the autonomous data relay buoy 10 if the center of drag, CD, is not at the position of the center of buoyancy, CB, as is shown. In this case, where the center of drag, CD, is below the center or buoyancy, CB, the ocean current 34*a* would tend to tilt the autonomous data relay buoy 10, to the right. If the center of drag, CD, were above the center or buoyancy, CB, the ocean current 34*a* would tend to tilt the autonomous data relay buoy 10 to the left. If the center of drag, CD, were coincident with the center of buoyancy, CB, the autonomous data relay buoy 10 would not tilt in the presence of the water drag. In some applications, it is desirable to design the autonomous data relay buoy 10 with a center of drag, CD, coincident with the center of buoyancy, CB. However, the positions of the center of buoyancy, CB, and the center of drag, CD, can also be selected in other ways.

As described above, a position along the central vertical axis 10*a* of the center of drag, CD, can be influence by a shape of the flotation ring 32. However, it will be recognized that, when the autonomous data relay buoy 10 tilts in the presence of the drag, the center of drag, CD, tends to move to a new position, a new position that may not be along the central vertical axis 10*a*. The center of drag, CD, can move greatly with only a small amount of tilt. Thus, predicting the actual orientation of the autonomous data relay buoy 10 under drag conditions becomes a difficult task. Furthermore, it will be recognized from discussion below in conjunction with FIGS. 2 and 2A, that an angle relative to the buoy 10 of the force represented by the line 92 can change according to a magnitude of the force (generated by a signal/tether line). Therefore, the point 96 can also move along or about the central vertical axis 10*a*. Thus, prediction of the static and dynamic motion of the buoy 10 under a variety of current and wave conditions, and selection of design characteristics, including, but not limited to, static positions of the center of buoyancy, CB, center of drag, CD, center of mass, CM, center of virtual mass, CM', and the point 96, in order to achieve a stable buoy can be a difficult problem.

Computer models exist that can assist in the prediction of buoy behaviors under the static conditions described above, and also under dynamic conditions described above and below. For example, one computer program that can be used is Orcaflex from Orcina, Ltd.

With regard to dynamic motion of the autonomous data relay buoy 10 in the presence the current 34*a* having both an average horizontal component and an oscillating component, the virtual center of mass. CM', affects the dynamic motion. Because the chamber 28*c* is below the center of mass, CM, the virtual center of mass, CM', is below the center of mass, CM. The position of the virtual center of mass, CM', does not affect the above two case of static stability of the autonomous data relay buoy 10. However, the virtual center of mass, CM', can influence dynamic behavior of the autonomous data relay buoy 10 when subjected to oscillating wave motion. In effect, the water 74 within the chamber 28*c* adds inertia to the autonomous data relay buoy 10, inertia below the center of mass, CM, resulting in the autonomous data relay buoy 10 being less influenced by the oscillating horizontal component of the current 34*a*, and therefore, resulting in less tilting back and forth in the presence of waves.

Dashed lines are used to show hypothetical and separate static forces 92 and 94 acting upon the tether assembly 76 at different times, which may be induced by the tether line 80 (FIG. 1) to which the autonomous data relay buoy 10 is coupled. The dashed line 92 is indicative of a desired force direction, the direction of which is influenced by the floats 82*a*-82*d* of FIG. 1. The dashed line 92 intersects the central vertical axis 10*a* at a point 96. The force 92 acts as a force at the point 96. The dashed line 94 is indicative of a much less desirable force direction, which is more like a force direction that may be achieved without having the floats 82*a*-82*d* of FIG. 1. The force 94 acts as a force at a point 98.

If the point 96 were coincident with the center of buoyancy, CB, the force 92 would not tend to tilt the autonomous data relay buoy 10. However, since the point 96 is below the center of buoyancy, CB, the force 92 tends to tilt the autonomous data relay buoy 10 to the left. If the point 96 were above the center of buoyancy, CB, the force 92 would tend to tilt the autonomous data relay buoy 10 to the right. Thus, in some applications, it is desirable that the force 92 aligns in such a way with the autonomous data relay buoy 10 that the point 96 is coincident with the center of buoyancy, CB. However, the position of the point 96 can be selected in other ways as well.

In some arrangements, it is possible to design the autonomous data relay buoy 10 such that the center of mass, CM, is not aligned on the central vertical axis 10*a*. For example, in FIG. 1B, the center of mass, CM, can be to the right of the right of the center of buoyancy, CB, which will tend to make the autonomous data relay buoy 10 tilt to the right by a predetermined number of degrees when the autonomous data relay buoy 10 is experiencing the first static conditions, i.e., no water current 32 and no wave motion. For example, in some arrangements, the predetermined number of degrees is about ten degrees.

In other arrangements, the autonomous data relay buoy 10 is designed such that the center of mass is to the left of the right of the center of buoyancy, CB, which will tend to make the autonomous data relay buoy 10 tilt to the left by a predetermined number of degrees when the autonomous data relay buoy 10 is experiencing the first static conditions. For example, in these arrangements, the predetermined number of degrees is about ten degrees.

In either case, the predetermined angle that the autonomous data relay buoy 10 is designed to achieve under static conditions can serve to offset a tendency for the autonomous data relay buoy 10 to tilt in the opposite direction when experiencing a force along the line 92. This arrangement will be descried again in conjunction with FIGS. 2 and 2A.

Figure 2:
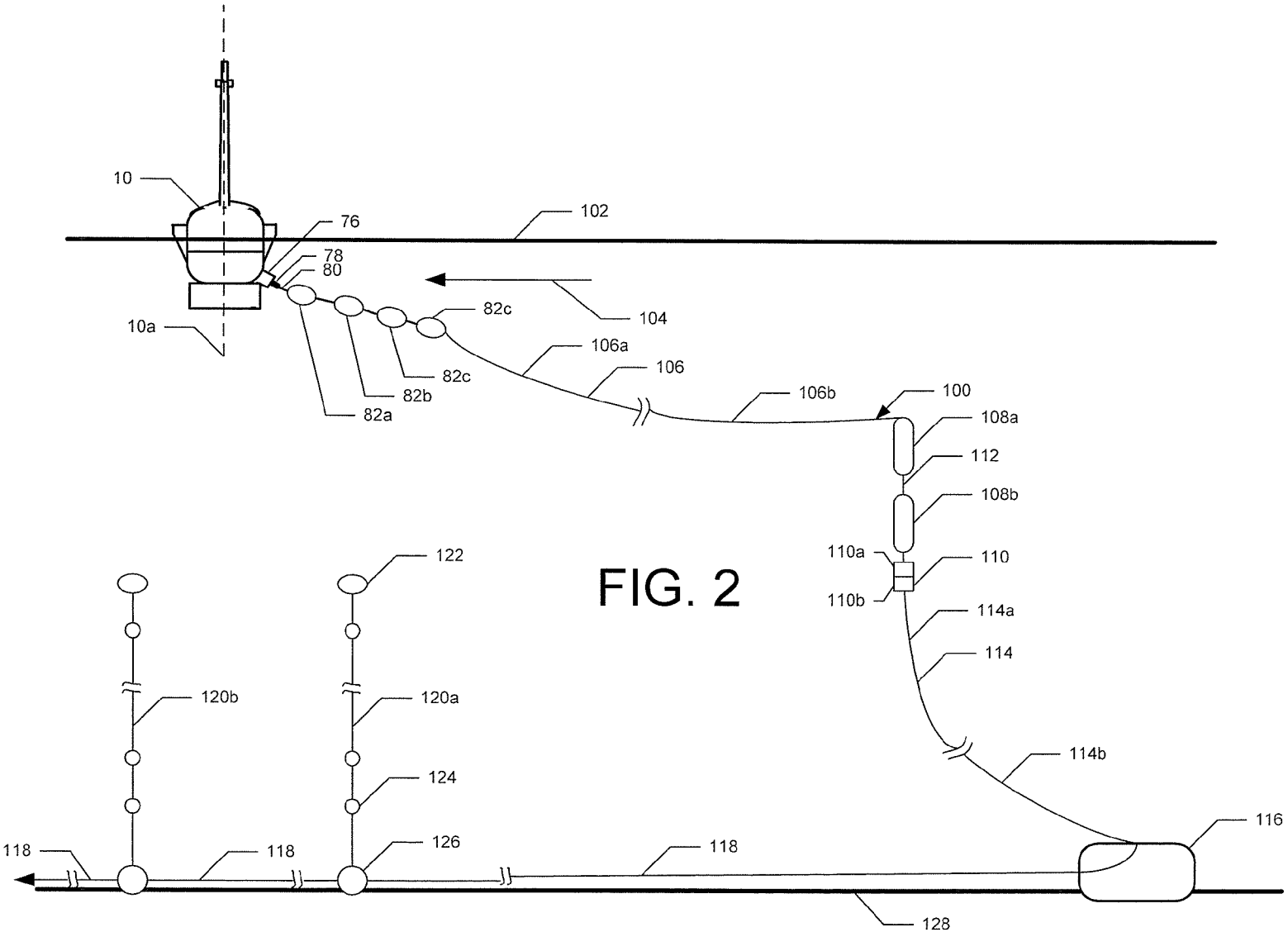
FIG. 2 is a pictorial showing the autonomous data relay buoy of FIG. 1 in a non-free-floating arrangement and experiencing a relatively high speed ocean current.

Referring now to FIG. 2, the autonomous data relay buoy 10 is shown deployed in water 102 and is coupled as a component of an acoustic system 100. The autonomous data relay buoy 10 experiences a relatively large current 104 with a relatively high average horizontal component. Waves and oscillating components of the current 104 are not shown for clarity.

Signals carried to (and in some embodiments, from) the autonomous data relay buoy 10 by the signal cable 80 are carried also via a signal cable 106 through intermediate floats 108*a*, 108*b*, and via a rotating coupling 110, and via a signal cable 114 to an anchor 116.

The system 100 can include one or more acoustic arrays, of which arrays 120*a*, 120*b* are but two examples. The arrays 120*a*, 120*b* are shown to be vertical arrays, though in other arrangements, the arrays 120*a*, 120*b* are horizontally disposed on an ocean bottom 128.

Each array, for example, the array 120*a*, includes a plurality of hydrophones 124, and for vertical arrangements, a float 122. The array 120*a* couples to an array cable 118 via a node 126. The node 126 can include a battery to power the array 120*a*, and transmission electronics within the node 126 to communicated hydrophone signals along a cable 118 to the anchor and up the signal cable 114.

Under the relatively high current 104, by design method described above in conjunction with FIG. 1B, under this particular static condition, the autonomous data relay buoy 10 can achieve an orientation wherein the vertical central axis 10*a* of the autonomous data relay buoy 10 is nearly vertical. This orientation is achieved in the presence of a relatively high tension in the signal cable 106, and a particular angle achieved by the floats 82*a*-82*d*.

Figure 2A:
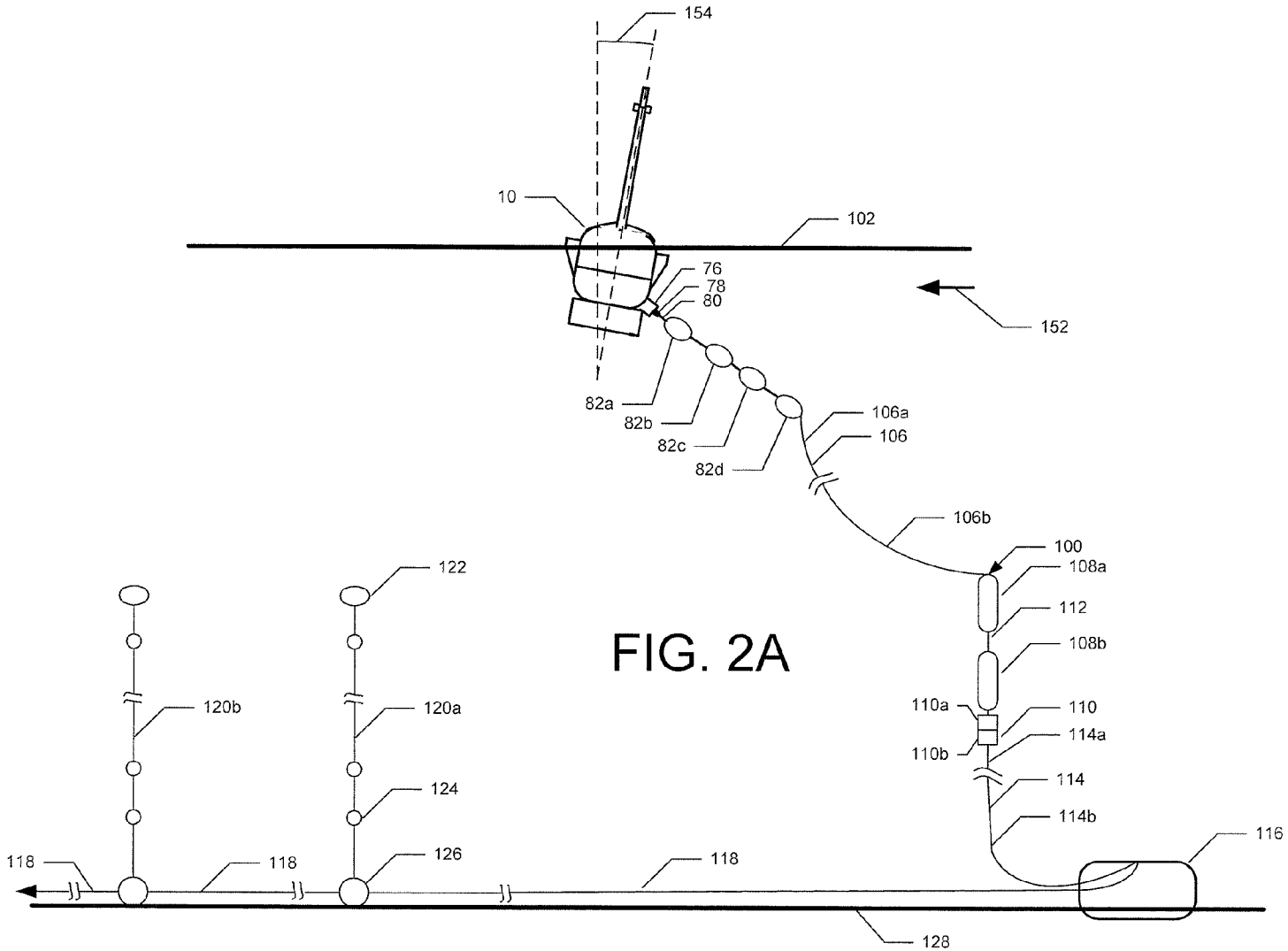
FIG. 2A is a pictorial showing the autonomous data relay buoy of FIG. 1 in a non-free-floating arrangement and experiencing a relatively low speed ocean current.

Referring now to FIG. 2A, the autonomous data relay buoy 10 is again shown deployed in the water 102 and is coupled as a component of the acoustic system 100. However, in this case, the autonomous data relay buoy 10 experiences a relatively small current 152 with a relatively small average horizontal component. Waves and oscillating components of the current 104 are not shown for clarity. This case is like the first static case considered above.

Under the relatively low current 152, by design method described above in conjunction with FIG. 1B, under this particular static condition, the autonomous data relay buoy 10 can achieve an orientation wherein the vertical central axis 10*a* of the autonomous data relay buoy 10 is tilted by an angle 154. This orientation is achieved in the presence of a relatively low (or zero) tension in the signal cable 106, and a particular angle achieved by the floats 82*a*-82*d* when under this tension. As described above in conjunction with FIG. 1B, in one particular arrangement, the buoy 10 is designed to achieve an angle 154 of about ten degrees under the indicated first static condition, i.e. when experiencing low or zero current and low or zero wave heights. However, the buoy 10 can be designed to achieve other angles, for example, an angle in a range of about five degrees to about fifteen degrees, under this condition.

Now taking into account wave motions (not shown) and dynamic behavior of the autonomous data relay buoy 10, particularly in view of the virtual mass provided by the flooded chamber 28*c* (FIG. 1B), the autonomous data relay buoy 10 will tend to stay relatively stable and essential ride the waves, substantially maintaining its static case orientations in the presence of the waves.

In one particular embodiment, the virtual mass is sized and positioned, and the autonomous data relay buoy 10 is otherwise designed, to maintain an orientation such that the central vertical axis 10*a* is within plus or minus twenty degrees of vertical under sea states of zero through four.

Figure 3:
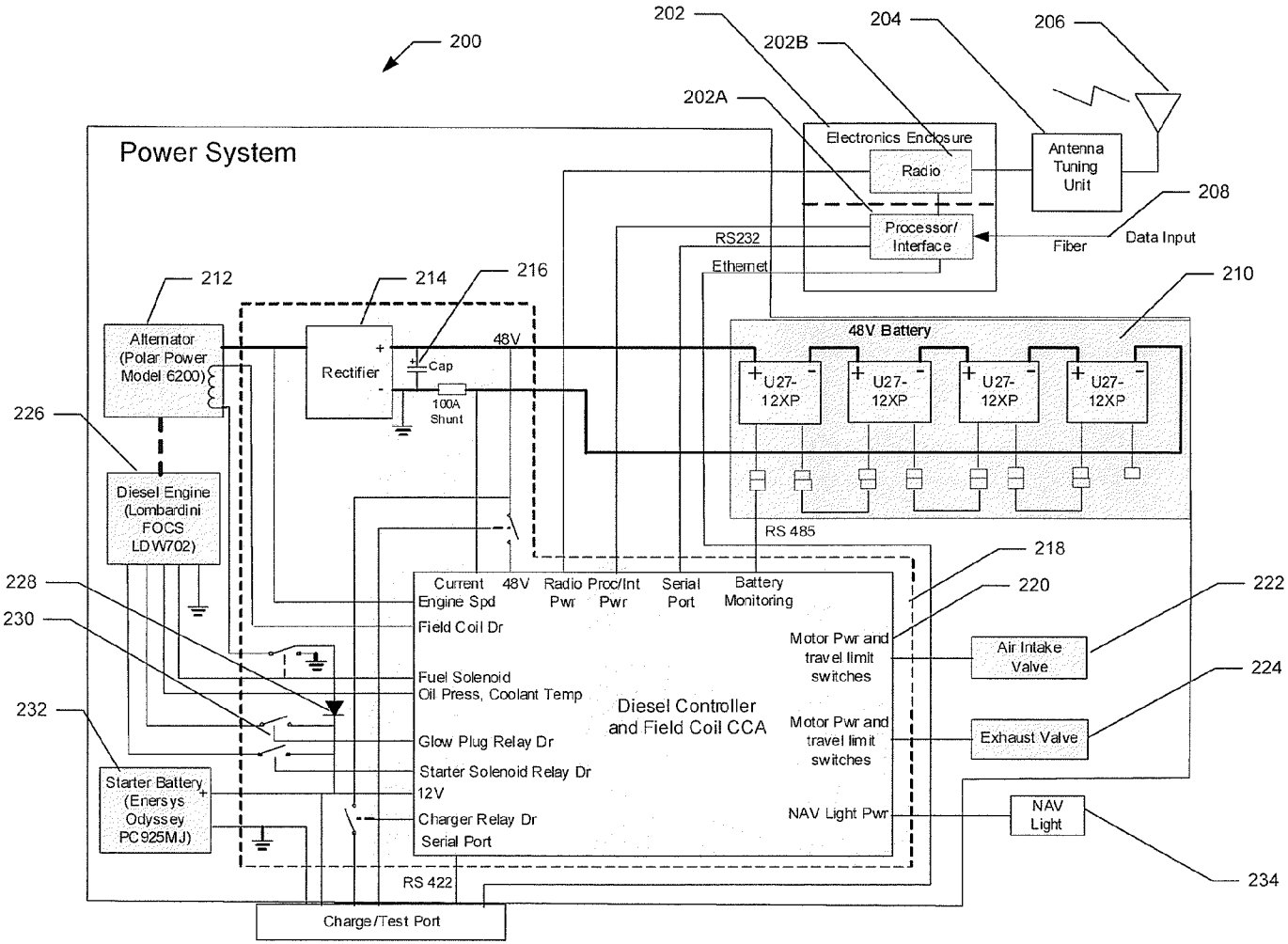
FIG. 3 is block diagram of electronic circuits that can be within the autonomous data relay buoy of FIG. 1.

Referring now to FIG. 3, an electronic system 200 includes a battery assembly 210, which can be the same as or similar to the storage battery 46 of FIG. 1. The battery assembly 210 is coupled to an alternator 212, which can be the same as or similar to the alternator 48 of FIG. 1. The alternator 212 is coupled to a diesel engine 226, which can be the same as or similar to the diesel engine 50 of FIG. 1. The diesel engine 226 is coupled to a starter battery 232, which can be the same as or similar to the starter battery 50*b* of FIG. 1. The electronic system 200 includes an air intake valve 222, which can be the same as or similar to the air valve 14 of FIG. 1, and an exhaust valve 224, which can be the same as or similar to the gas valves 40*a*, 40*b* of FIG. 1. The electronic system 200 further includes an antenna 206, which can be the same as or similar to the antenna 20 of FIG. 1, and electronics 218, 202, and 204, all of which together can be the same as or similar to the electronic circuits 52, 71*a* of FIG. 1.

Electronics 218 includes a diesel controller 220, which is configured to control the air intake vale 222 and the exhaust valve 224, to close the valves when the diesel engine 226 is not running and to open the valves when the diesel engine 226 is running.

The diesel controller 220 is also configured to sense a voltage associated with the battery assembly 210, and if the voltage is too low, i.e., below a battery voltage threshold, the diesel controller 220 is configured to start the diesel engine 226, thereby causing the alternator 212 to generate AC electricity, which is converted to DC electricity by a rectifier 214 and a filter 216 in order to charge the battery assembly 210 and the starter batter 232.

The diesel controller 220 is also configured to stop the diesel engine 226 after a period of time by way of switches 230. In some embodiments, the period of time can be a predetermined period of time, for example one hour. In other embodiments, the period of time can end when a charging current being fed to the battery assembly 210 reaches a predetermined value. In still other embodiments, the period of time can end when a voltage associated with the battery assembly 210 reaches a predetermined voltage.

Data 208 is received by the electronic system 200 at an input coupling, which can, in some arrangements be a fiber-optic coupling to receive a fiber-optic cable, for example the cable 80 of FIG. 1. A processor 202*a* is coupled to receive the data 208 and to provide the data to a radio 202*b* for transmission by the antenna 206 via a tuning unit 204. It will be understood that the tuning unit 204 operates to match an output impedance of the radio 202*b* with an impedance of the antenna 206, and also to electronically isolate the radio 202*b* from the antenna 206, particularly in the event of variations in the impedance of the antenna 206. Variations of antenna impedance are described above.

In some arrangements, the electronics 202 is within the electronics enclosure 71 of FIG. 1 and receives seawater cooling.

In some arrangements, the diesel controller 220 is coupled to the battery assembly 210 with a standard electronic interface, for example, an RS-485 interface. In some arrangements, the diesel controller 220 is coupled to the processor 202*a* with a standard electronic interface, for example, an RS-232 and/or Ethernet interface.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. A buoy for deployment in the ocean, comprising:

an engine;

an electric starter motor coupled to the engine;

an electrical alternator coupled to the engine, wherein the electrical alternator is configured to generate electricity when the engine is running;

a battery coupled to the electrical alternator, the battery having a battery voltage, wherein the electrical alternator is configured to charge battery with the electricity when the engine is running; and a fuel tank configured as a soft, flexible, and collapsible bladder coupled to the engine, configured to prevent fuel sloshing, wherein the fuel tank is continually surrounded by sea water such that, as fuel is expended and a fuel tank collapses accordingly, seawater continually fills in around the fuel tank resulting in a displacement of the buoy remaining substantially unchanged.

2. The buoy of claim 1, wherein the engine is a diesel engine, wherein the fuel tank is a diesel fuel tank, and wherein the fuel is diesel fuel.

3. The buoy of claim 2, wherein the battery comprises a starter battery coupled to the electric starter motor and also a storage battery, wherein the storage battery has the battery voltage, wherein the electrical alternator is configured to charge the storage battery and the starter battery with the electricity when the engine is running.

4. The buoy of claim 3, wherein the storage battery has a battery capacity of at least six thousand watt-hours.

5. The buoy of claim 3, further comprising an electronic circuit coupled to the storage battery and configured to compare the battery voltage with a battery voltage threshold, wherein the electronic circuit is also coupled to the electric starter motor and to the diesel engine, wherein the electronic circuit is configured to start the diesel engine and to run the diesel engine for a period of time when the battery voltage is below the battery voltage threshold, and wherein the electronic circuit is configured to stop the diesel engine after the period of time, wherein the period of time during which the diesel engine is running is determined in accordance with at least one of the battery voltage, an electrical charging current corresponding to the electricity, a predetermined time value, or a radio command.

6. The buoy of claim 5, wherein the diesel engine, the electrical alternator, the electronic circuit, and the storage battery are selected to result in an overall efficiency corresponding to less than three hundred grams of diesel fuel per kilowatt-hour.

7. The buoy of claim 3, wherein the diesel fuel tank is configured to hold a volume of diesel fuel sufficient to run the diesel engine sufficiently to maintain a full charge of the storage battery for at least sixty days while supplying an average of at least three hundred fifty watts of output power from the storage battery.

8. The buoy of claim 3, wherein the diesel engine and the electrical alternator are capable of generating at least twenty thousand watts of power.

9. The buoy of claim 3, further comprising an air intake structure coupled to the diesel engine, the air intake structure comprising:

a tube having an air passage;

a water baffle coupled to the tube; and an air-water separator coupled to the tube and configured to separate water from air.

10. The buoy of claim 9, further comprising an air valve coupled to the tube and coupled to the electronic circuit, wherein the air valve is configured to close the air passage when the diesel engine is not running and to open the air passage when the diesel engine is running.

11. The buoy of claim 3, further comprising an exhaust structure coupled to the diesel engine, the exhaust structure comprising:

an exhaust tube having a diesel engine exhaust gas passage;

first and second water baffles coupled to the exhaust tube and disposed on opposite sides of the buoy; and first and second gas valves coupled to the exhaust tube and coupled to the electronic circuit, wherein the first and second exhaust gas valves are configured to close the diesel engine exhaust gas passage when the diesel engine is not running and to open the diesel engine exhaust gas passage when the diesel engine is running.

12. The buoy of claim 1, further comprising a virtual mass chamber coupled to the fuel tank, wherein the virtual mass chamber comprises one or more water ports configured to allow a volume of water to enter the virtual mass chamber, wherein, once filled with the volume of water, the buoy has an effective center of mass lower in position than a center of mass of the buoy without the volume of water.

13. The buoy of claim 12, further comprising a cooling heat exchanger coupled to the diesel engine and configured to cool the diesel engine, wherein the cooling heat exchanger is disposed within the virtual mass chamber so as to be in contact with the volume of water.

14. The buoy of claim 1, wherein the buoy has a central vertical axis, wherein the buoy has a center of buoyancy and a center of drag both generally upon the central vertical axis, wherein the buoy further comprises:

a coupling structure; and a tether line structure coupled to the coupling structure and configured to tether the buoy to an anchor, wherein the coupling structure is coupled to a side of the buoy distal from the central vertical axis; wherein a position of the coupling structure is selected to result in the central vertical axis maintaining at a vertical angle between zero degrees and twenty degrees when the buoy is in the presence of sea states between zero and four.

15. The buoy of claim 14, wherein the tether line structure comprises at least one float configured to maintain an angle of the central vertical axis of the buoy within a range of five and fifteen degrees when the buoy is in the presence of a sea state of zero having a zero average horizontal current.

16. The buoy of claim 1, wherein the buoy further comprises:

an antenna; and radio electronics coupled to the antenna.

* * * * *